United States Patent [19]

Foley

[11] Patent Number: 4,982,968

[45] Date of Patent: Jan. 8, 1991

[54] GAME DART

[75] Inventor: Charles F. Foley, Charlotte, N.C.

[73] Assignee: Innoland, Inc., Pineville, N.C.

[21] Appl. No.: 305,519

[22] Filed: Feb. 2, 1989

[51] Int. Cl.[5] ..... A63B 65/02

[52] U.S. Cl. ..... 273/420

[58] Field of Search ..... 273/419–424, 273/347

[56] References Cited

U.S. PATENT DOCUMENTS

| | | | |
|---|---|---|---|
| 2,819,086 | 1/1958 | Nelson | 273/420 |
| 2,899,773 | 8/1959 | Lockwood | 273/423 X |
| 3,746,334 | 7/1973 | Stubblefield | 273/420 X |
| 3,784,199 | 1/1974 | Chmela | 273/420 X |
| 3,894,736 | 7/1975 | Foley | 273/347 |
| 4,257,613 | 3/1981 | Straten | 273/347 |
| 4,737,128 | 4/1988 | Moormann et al. | 273/424 X |

FOREIGN PATENT DOCUMENTS

| | | | |
|---|---|---|---|
| 2643228 | 3/1978 | Fed. Rep. of Germany | 273/347 |
| 736644 | 9/1955 | United Kingdom | 273/420 |

OTHER PUBLICATIONS

Advertising Flyer, "Striker", by InnoLand, Inc. Pineville, N.C., undated.

*Primary Examiner*—Paul E. Shapiro

*Attorney, Agent, or Firm*—Shefte, Pinckney & Sawyer

[57] ABSTRACT

A "safety" game dart for use with a dart board having plural projecting dart-receiving fingers, includes an elongate dart body with plural guide wings at one end and a blunt non-metal tip at the opposite end. The tip is formed of an elastomer, e.g. rubber, to be compressibly resilient for compression fitting into a mounting recess in the dart body and to compress upon impact to minimize possible injury or damage to persons or objects accidentally struck by the dart. Each wing includes a laterally projecting planar main guide portion coplanar with the elongate extent of the dart body and an angularly oriented planar tail portion transverse with respect to the dart body, to induce rotation of the dart during flight.

10 Claims, 3 Drawing Sheets

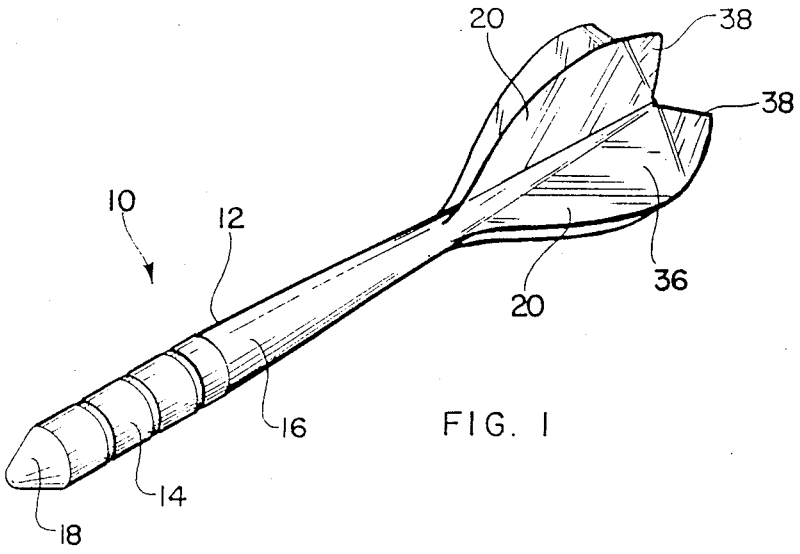
FIG. 1
FIG. 2
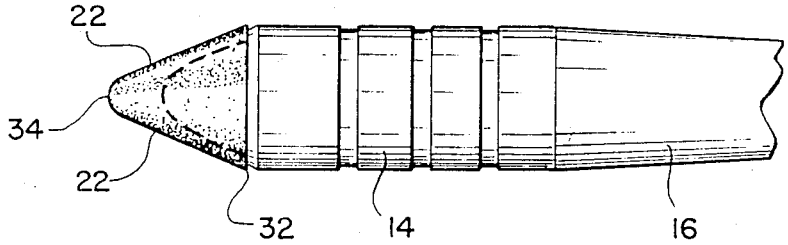
FIG. 3
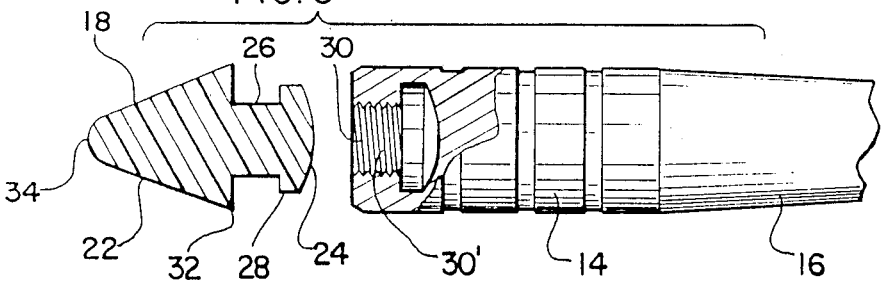

GAME DART

BACKGROUND OF THE INVENTION

The present invention relates generally to dart games and darts for use therewith and, more particularly, to a so-called "safety" dart of the type having a generally blunt non-metal tip adapted for use with a compatible "safety" dart board equipped with plural projecting dart-receiving fingers.

Dart games employing safety darts and game boards of the aforementioned type have become increasingly popular in recent years, especially for use by children, because the darts employed represent a substantially lesser risk of injury to participants and damage to walls, doors, furniture and other household articles which might be struck by an errantly thrown dart, as compared to more traditional dart games employing sharpened metal-tipped darts. Representative examples of such dart games and game components are disclosed in U.S. Pat. No. 3,894,736 by the same inventor as the present invention, and also may be found in the "STRIKER" brand of dart game produced and sold by Innoland, Inc., of Pineville, North Carolina, the assignee hereof.

While such dart games have met with a reasonable degree of commercial success and consumer acceptance, certain minor disadvantages still remain. Typically, the safety tip provided on darts employed in such safety dart games are formed of a generally rounded configuration from a relatively hard non-resilient plastic material and are mounted to the main body of the dart by a threaded connection. Although this form of safety tip represents a significant improvement over metal-tipped darts in terms of reducing the risk of injury and damage from the dart, the relatively hard plastic material from which the safety tip is fabricated nevertheless is capable of indenting the walls and doors of many typical homes and also may inflict painful bruises upon direct impact with a person's body. Additionally, the threaded mounting of the safety tip to the dart body has been found in practice to wear and deteriorate rapidly after repeated impact of the tip with the dart board, with the result that the worn tip may in turn tend to easily become dislodged from the dart body. Such safety darts also are commonly provided with a knurled or otherwise roughened metal collar, or so-called barrel, forming part of the dart body immediately adjacent the safety tip to provide the dart with an annular gripping surface which will frictionally engage the dart-receiving fingers of the dart board to retain the dart upon impact with the board. To insure this function, the plastic tip must be of a maximum transverse dimension which does not exceed the corresponding dimension of the barrel which is slightly greater than the spacing of the fingers of the dart board to provide a wedging action. Disadvantageously, however, this function of the barrel also tends to rapidly wear the fingers of the dart board and since the fingers are not entirely resilient, tends to laterally bend and deform the fingers over time, ultimately to the point that the fingers are rendered incapable of properly gripping and retaining the dart.

SUMMARY OF THE INVENTION

It is accordingly an object of the present invention to provide an improved game dart of the aforementioned general type which overcomes these disadvantages.

Briefly summarized, as with conventional game darts of this type, the dart of the present invention includes an elongate dart body, a plurality of guide wings, commonly called "flights," at one end of the body and a blunt safety tip at the opposite end of the body. According to the present invention, the dart body is provided with a tip mounting recess formed in such opposite end of the body and the tip is provided with a mounting portion compression fitted into the recess. The tip is of a sufficient softness to compress upon impact with interior building walls, furniture and other common household articles to minimize any possibility of damage thereto upon accidental impact thereof.

In the preferred embodiment of a dart according to the present invention, the softness of the tip is of a durometer scale hardness of between approximately fifty (50) and eighty (80), but preferably less than approximately sixty (60). For example, the tip may be formed of rubber or a similar elastomer. The body of the dart includes a rigid barrel at such opposite end with a leading end portion of the barrel being disposed adjacent the tip and the tip having a base portion at least predominantly covering the leading end portion of the barrel. In one embodiment, the barrel is of a transverse dimension about the same as or slightly less than the spacing between the dart-receiving fingers of the dart board and the base portion of the tip is of a larger transverse dimension than the barrel to fully cover the leading end of the barrel so that the base portion of the tip frictionally engages the fingers to retain the dart with limited wearing of the fingers by the barrel.

The tip is substantially conical in shape, preferably having a conical taper angle with respect to the elongate extent of the dart body of less than about forty-five degrees (45°), in order to minimize any possibility of directly aligned impact of the tip with the fingers of the dart board.

Each guide flight may include a first substantially planar guide portion projecting laterally outwardly from the body in generally coplanar orientation with the elongate extent of the body and a second substantially planar guide portion projecting angularly with respect to the first portion at a generally transverse orientation with respect to the elongate extent of the body, thereby to induce rotational movement of the dart body during flight of the dart.

BRIEF DESCRIPTION OF THE DRAWINGS

FIG. 1 is a perspective view of a game dart according to one preferred embodiment of the present invention;

FIG. 2 is a partial side elevational view of the game dart of FIG. 1, showing the leading end of the dart;

FIG. 3 is an exploded view, partially in lengthwise cross section and partially in side elevation, of the leading end of the dart of FIG. 2;

DESCRIPTION OF THE PREFERRED EMBODIMENT

Figure 4:
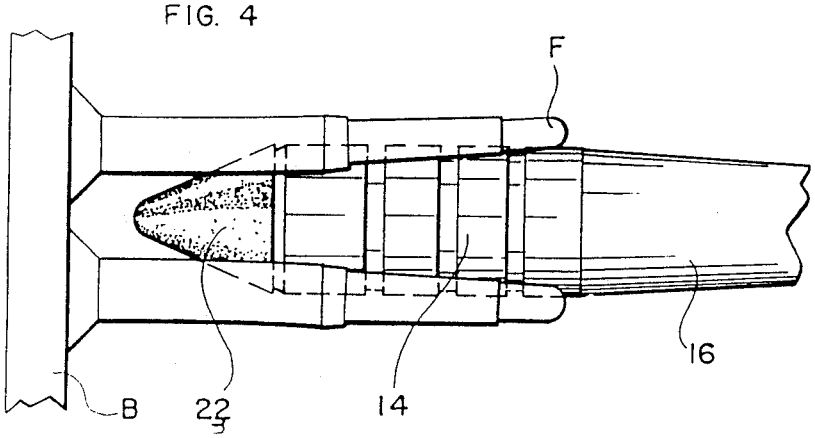
FIG. 4 is a cross-sectional view through a representative safety dart board showing the leading end of the dart of FIG. 2 as received and retained by the fingers of the board.

Referring now to the accompanying drawings and initially to FIG. 1, a game dart according to one preferred embodiment of the present invention is shown generally at 10. The dart 10 includes an elongate dart body 12 having a cylindrical metal barrel portion 14 at the leading end of the body 12 affixed coaxially to a linear shaft portion 16 of a circular-cross section which tapers narrowingly to the opposite trailing end of the body 12. In conventional manner, the barrel portion 14 is of a diameter slightly greater than the spacing between the fingers F of a compatible dart board B (FIG. 4) for frictional engagement therebetween when the dart 10 impacts the board to retain the dart 10 at the point of impact. A blunt safety tip 18 is mounted to the leading end of the barrel portion 14 of the body 12 and a plurality of guide flights or wings 20 project laterally from the shaft portion 16 of the body 12 at its trailing end.

As best seen in FIGS. 2 and 3, the tip 18 of the dart 10 is configured to have a conical head portion 22 at its leading end and a coaxial mounting portion 24 at its trailing end, the mounting portion 24 having a reduced-diameter cylindrical neck 26 and a larger diameter circular shoulder 28. A tip-mounting recess 30, corresponding in shape to the mounting portion 24 of the tip 18 is formed in the axial leading end face of the barrel portion 14 of the dart body 12 coaxial therewith. The tip 18 is fabricated of a resilient material having sufficient compressibility to permit the mounting portion 24 of the tip to be compression-fitted into the mounting recess 30 of the barrel portion 14 while also having a sufficient softness of the head portion 22 of the tip 18 to compress upon impact with interior building walls, furniture and other household articles and with persons and pets to best minimize possible damage or injury as a result of accidental impact by the dart 10. For these purposes, the tip 18 preferably is formed of an elastomeric material having a durometer scale hardness of between approximately fifty (50) and eighty (80), but preferably less than approximately sixty (60). A natural or synthetic rubber material has been found to be ideally suited for fabrication of the tip 18, although it will be understood that any other suitable elastomer exhibiting comparable properties of compressibility and resiliency may also be utilized.

The head portion 22 of the tip 18 is formed of a substantially conical configuration tapering from a base edge 32 immediately adjacent the neck 26 of the mounting portion 24 to a narrow rounded nose 34 at the leading end of the tip 18. Preferably, the head portion 22 of the tip 18 is of a diameter at its base edge 32 approximately equal to the diameter of the cylindrical barrel portion 14 so as to substantially cover the leading end face of the barrel portion 14. It is additionally preferred that the conical taper angle of the head portion 22 of the tip 18 be less than about forty-five degrees (45°) with respect to the common longitudinal axis of the tip 18 and the dart body 12, converging at the nose 34 to as small a diameter as reasonably practical while remaining rounded. For sake of comparison, the rounded configuration and reduced diameter of a conventional hard plastic dart tip is indicated in broken lines in FIG. 2.

The guide wings of the dart 10 may be of any conventional aerodynamic configuration and disposition suitable to guide the dart 10 in a substantially linear flight path when projected or, alternatively, the guide wings may be formed in the configuration of the wings 20. As may best be seen in FIGS. 4 and 5, the guide wings 20 are arranged at equidistant spacings circumferentially about the trailing end of the shaft portion 16 of the dart body 10, each of the guide wings 20 being of an overall generally arcuate shape having a substantially planar main leading guide portion 36 projecting laterally outwardly from the shaft portion 16 in generally coplanar relationship with the longitudinal axis of the dart body 12 and a substantially planar trailing tail guide portion 38 oriented angularly to the main leading guide portion 36 to extend in generally transverse relationship with respect to the longitudinal axis of the dart body 12, each tail portion 38 projecting in the same direction circumferentially with respect to the shaft portion 16.

The operation and advantages of the dart 10 may thus be understood. The resiliency, compressibility and softness of the elastomeric material from which the tip 18 is formed enables each of the aforementioned disadvantages of conventional safety darts to be overcome. First of all, in contrast to conventional darts utilizing tips of relatively hard, non-resilient plastic materials, the head portion 22 of the tip 18 is sufficiently soft to compress and thereby absorb or dissipate energy upon impact with an ordinary interior building wall, door, furniture and other common household items and, likewise, upon striking a person's body so as to best minimize any possibility of damage or injury as a result of an errant dart. At the same time, the compressibility and resiliency of the tip 18 enables its mounting portion 24 to be configured with the enlarged shoulder 28 and still be compression fitted into the recess 30 of the barrel portion 14. As a result, the shoulder 28 is sufficient to retain the tip 18 securely mounted to the barrel portion 14 of the dart body 12 without utilizing a threaded connection therebetween as in conventional darts. Thus, the repeated impact of the dart 10 with a compatible dart board only serves to reinforce the assemblage of the tip 18 and the barrel portion 14, whereas in conventional darts employing a threaded connection such repeated impacts progressively deteriorate the threaded connection, as aforementioned. While a threaded connection is not employed, the entrance area of the recess 30 in the barrel portion 14 may desirably be provided with threads, as indicated at 30' in FIG. 3, to facilitate assembly of the tip 18 and the barrel portion 14 by a combined twisting and compressive action. Further, as seen in FIG. 3, the compressibility and resiliency of the tip 18 enables the head portion 22 to be formed of the same or even a slightly greater base diameter than the barrel portion 14 so as to at least predominantly or even fully cover the leading end face of the barrel portion 14 to reduce wearing of the dart-receiving fingers F of a compatible dart board B (FIG. 4) by the barrel portion 14 upon impact of the dart 10 with the board, the compressibility of the tip 18 enabling it to yield sufficiently to the dart receiving fingers F so as not to interfere with desirable frictional engagement between the fingers and the barrel necessary to retain the dart at its point of impact with the board, as shown in FIG. 4. In contrast, as aforementioned, in conventional darts employing a non-resilient tip of relatively hard plastic material, the tip is formed of a sufficiently lesser diameter than the barrel portion, taking into account normal manufacturing tolerances, as indicated in broken lines in FIG. 2., to insure that the tip does not predominantly or fully cover the leading end of the barrel portion 14 to insure desirable frictional engagement between the barrel portion and the dart receiving fingers of a compatible board, but disadvantageously this also results in accelerated wearing of the fingers. The conical configuration and relatively small diameter nose 34 of the head portion 22 of the dart 10 minimizes the chance of directly aligned "head on" impact of the nose 34 of the tip 18 with any dart-receiving finger of the dart board, which might produce an undesired rebound of the dart 10 away from the board, and guides the head portion 22 to deflect laterally upon contact with a finger F into receipt between adjacent fingers F of the dart board B upon impact therewith to enhance retention of the dart 10 by the fingers F of the board B. The angularly-projecting tail portions 38 of the guide wings 20 serve to induce rotation of the dart 10 about the longitudinal axis thereof when thrown, which optimizes and stabilizes linear flight of the dart 10 and causes the tip 18 of the dart 10 more readily to deflect laterally upon impact with a finger F to further enhance retention of the dart 10 by the board B.

Figure 5:
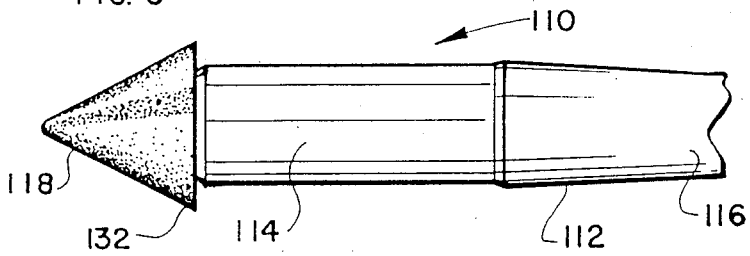
FIG. 5 is a partial side elevational view of a game dart according to a second preferred embodiment of the present invention.
Figure 6:
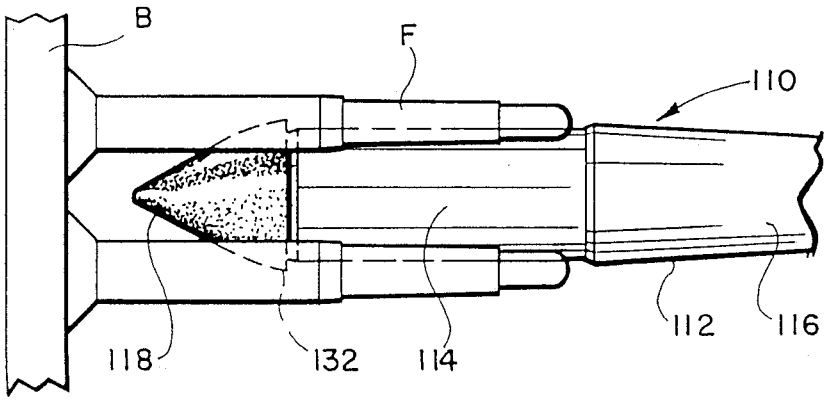
FIG. 6 is a cross-sectional view through a safety dart board showing the leading end of the dart of FIG. 5 as received and retained by the fingers of the board.
Figure 7:
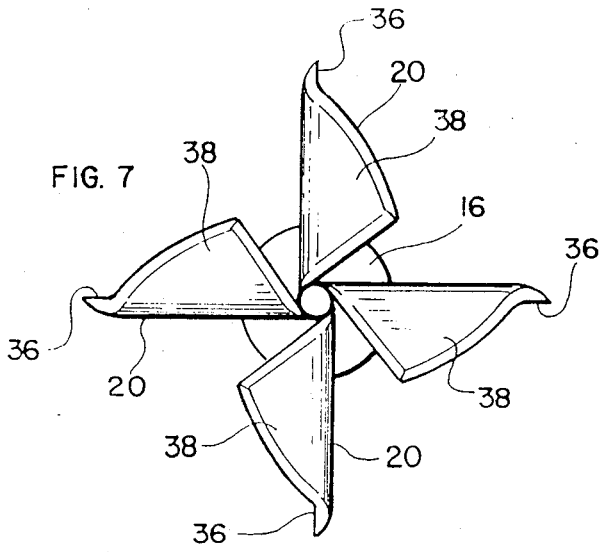
FIG. 7 is an end elevational view of the trailing end of the dart of FIG. 1.
Figure 8:
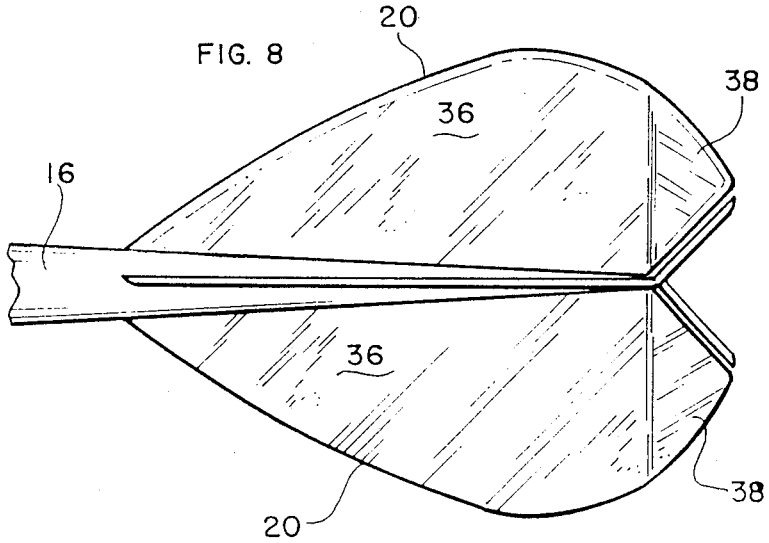
FIG. 8 is another partial side elevation of the dart of FIG. 1, showing the trailing end thereof.

FIGS. 5 and 6 illustrate an alternate embodiment of the game dart of the present invention, generally indicated at 110, which is adapted to still further limit wearing of fingers F of a compatible dart board B. The dart 110 is basically of a comparable construction to the dart 10, including an elongate dart body 112 having a cylindrical metal barrel portion 114 affixed coaxially at the leading end of a linear shaft portion 116 with a safety tip 118 mounted to the leading end of the barrel portion 114 and plural guide flights (not shown) at the trailing end of the dart body 112. However, in contrast to the dart 10, the diameter of the barrel portion 114 of the dart 110 is of about the same or a slightly smaller dimension than the spacing between the dart receiving fingers F of the dart board B and the base diameter of the spacing of the fingers F. By this construction, tip 118 not only functions to cover the leading end of the barrel portion 114 to resist frictional wearing of the fingers F but also actually serves itself to frictionally engage the fingers F to retain the dart 110 in place at the location of impact so that the barrel portion 114 need not be relied on for such purpose. Specifically, since the barrel portion 114 is of a diameter smaller than the spacing between the fingers F, the barrel portion 114 does not act to deflect the fingers F away from one another as with the dart 10 and conventional safety darts. Thus, as the relatively larger diameter tip 118 passes between adjacent fingers F of the board B upon impact, the fingers F do not significantly deflect away from one another but instead act to compress the resilient elastomeric material of the tip 118, producing more than sufficient frictional engagement to retain the dart 110 at the point of impact, even when received between only two retaining fingers, without bending deformation of the fingers F. Advantageously, the compressibility of the tip 118 enables its base edge 132 to conform to minor variations in the spacing between the fingers so that any tendency of the dart 110 to rebound from the board B is further reduced. Since the fingers F of typical safety dart boards B are of a tapered configuration as shown in each of FIGS. 4 and 6, the tip 118 becomes increasingly compressed the deeper it penetrates between the fingers F of the board B, rather than producing increased deflection of the fingers F away from one another as would be the case with conventional safety darts, so that the frictional forces retaining the dart 110 at its point of impact with the board B are correspondingly greater with greater dart penetration. Thus, the dart 110 does not experience a greater tendency to rebound from the board B when thrown against the board B with increasing force, as would be the case with conventional safety darts, but instead is retained by the fingers F of the board B with correspondingly increased frictional force, with the tip 118 acting in a barb-like manner. As will also be recognized, damage and wearing of the fingers F is even further reduced due to the relatively smaller diameter barrel portion 114. The barrel portion 114 preferably is formed with a smooth outer periphery to further minimize any wearing of the fingers F.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A game dart of the type adapted for use with a dart board having plural projecting dart-receiving fingers, said dart comprising an elongate body, a plurality of guide flights at one end of said body, and a compressibly resilient tip at the opposite end of said body, said body having a tip mounting recess formed in said opposite end of said body and said tip having a mounting portion compression fitted into said recess, said tip being substantially conical to minimize any possibility of directly aligned impact with the fingers of the dart board, said tip having a base portion generally completely covering said opposite end of said body for frictional engagement of said base portion with the dart-receiving fingers of the dart board and being conically tapered from said base portion at a conical tape angle with respect to the elongate extent of said body of less than about forty-five degrees (45°), said tip being of predetermined durometer scale hardness of between aprroximately fifity (50) and eighty (80) to provide sufficient relative softness to compress upon impact with a person's body or with interior building walls, furniture and other common household articles to minimize any possibility of injury or damage thereto upon accidental impact thereof and to resist tendency to rebound upon impact with the dart board to optimize retention of said tip by the fingers of the dart board, said body having a rigid barrel at its said opposite end, said barrel having a leading end portion adjacent said tip and said tip having a base portion of a larger transverse dimension than said barrel for fully covering said leading end of said barrel and for frictional engagement of said base portion of said tip with the dart-receiving fingers of the dart board.

2. A game dart according to claim 1 and characterized further in that said tip is formed of an elastomeric material.

3. A game dart according to claim 1 and characterized further in that said softness of said tip is less than approximately sixty (60).

4. A game dart according to claim 1 and characterized further in that said barrel is of a transverse dimension essentially no greater than about the same as the spacing between the dart-receiving fingers of the dart board to limit wearing and deformation of the fingers by the barrel.

5. A game dart according to claim 1 and characterized further in that each said guide flight includes a first guide portion projecting laterally outwardly from said body and a second guide portion projecting angularly with respect to said first portion for inducing rotational movement of said body during flight of said dart.

6. A game dart according to claim 5 and characterized further in that said first portion of each guide flight is substantially planar and is oriented generally coplanarly with the elongate extent of said body and said second portion of each said guide flight is substantially planar and is oriented generally transversely with respect to the elongate extent of said body.

7. A game dart of the type adapted for use with a dart board having plural projecting dart-receiving fingers, said dart comprising an elongate body, a plurality of guide flights at one end of said body, and a compressibly resilient tip at the opposite end of said body, said body having a tip mounting recess formed in said opposite end of said body and said tip having a mounting portion compression fitted into said recess, said tip having a sufficient softness to compress upon impact with a person's body or with interior building walls, furniture and other common household articles to minimize any possibility of injury or damage thereto upon accidental impact thereof, said body having a rigid barrel at its said opposite end, said barrel having a leading end portion adjacent said tip and said tip having a base portion of a larger transverse dimension than said barrel for fully covering said leading end of said barrel and for frictional engagement of said base portion of said tip with the dart-receiving fingers of the dart board.

8. A game dart according to claim 7 and characterized further in that said barrel is of a transverse dimension essentially no greater than about the same as the spacing between the dart-receiving fingers of the dart board to limit wearing and deformation of the fingers by the barrel.

9. A game dart of the type adapted for use with a dart board having plural projecting dart-receiving fingers, said dart comprising an elongate body, a plurality of guide flights at one end of said body, and a generally blunt safety tip at the opposite end of said body, said tip having a base portion of a larger transverse dimension than said opposite end of said body for fully covering said opposite end of said body and for frictional engagement of said base portion of said tip with the dart-receiving fingers of the dart board.

10. A game dart according to claim 9 and characterized further in that said body is of a transverse dimension essentially no greater than about the same as the spacing between the dart-receiving fingers of the dart board to limit wearing and deformation of the fingers by the body.

* * * * *

UNITED STATES PATENT AND TRADEMARK OFFICE

CERTIFICATE OF CORRECTION

PATENT NO. : 4,982,968

DATED : January 8, 1991

INVENTOR(S) : Charles F. Foley

It is certified that error appears in the above-identified patent and that said Letters Patent is hereby corrected as shown below:

Column 5, Line 39, after "diameter of the" add -- safety tip 118 at its edge 132 is slightly larger than the barrel diameter and the --.

Column 5, Line 40, after "construction," add -- the --.

Column 6, Line 56, reads "aprroximately" but should read -- approximately --.

Signed and Sealed this

Sixth Day of October, 1992

*Attest:*

DOUGLAS B. COMER

*Attesting Officer*

*Acting Commissioner of Patents and Trademarks*